US006129351A

United States Patent [19]

Oohara et al.

[11] Patent Number: 6,129,351

[45] Date of Patent: Oct. 10, 2000

[54] OVERLAP DETECTION APPARATUS AND METHOD

[75] Inventors: Shunichi Oohara, Ibaraki-ken; Taichiro Yamashita, Tsuchiura; Naoki Sasaki, Ibaraki-ken; Masahisa Aoyagi, Ishioka; Hideo Inui, Owariasahi; Junji Fujita, Nagoya, all of Japan

[73] Assignee: Hitachi, Ltd., Tokyo, Japan

[21] Appl. No.: 09/401,941

[22] Filed: Sep. 23, 1999

Related U.S. Application Data

[63] Continuation of application No. 09/082,525, May 21, 1998, Pat. No. 5,984,303.

[30] Foreign Application Priority Data

May 23, 1997 [JP] Japan ..... 9-133199

[51] Int. Cl.[7] ..... B65H 7/12

[52] U.S. Cl. ..... 271/262; 271/263; 271/265.04

[58] Field of Search ..... 271/262, 263, 271/265.04, 259, 265.02, 261, 265.03, 188

[56] References Cited

U.S. PATENT DOCUMENTS

| | | | |
|---|---|---|---|
| 3,834,289 | 9/1974 | Behrens et al. . | |
| 4,577,852 | 3/1986 | Grunder . | |
| 5,560,598 | 10/1996 | Goldkuhle . | |
| 5,984,303 | 11/1999 | Oohara et al. | 271/262 |

FOREIGN PATENT DOCUMENTS

| | | |
|---|---|---|
| 32 25 243 | 3/1983 | Germany . |
| 43 37 004 | 5/1995 | Germany . |
| 60-30617 | 7/1985 | Japan . |
| 60-30618 | 7/1985 | Japan . |
| 4-266349 | 9/1992 | Japan . |
| 7-172628 | 7/1995 | Japan . |

*Primary Examiner*—David H. Bollinger
*Attorney, Agent, or Firm*—Antonelli, Terry, Stout & Kraus, LLP

[57] ABSTRACT

An overlap detection apparatus having a conveyance path for conveying letters including a letter release section where the letters are not held, a bending section formed in the letter release section, and a butt into which the forward end of the letters released from the conveyance path in the bending section is brought into contact. A detector is provided for detecting the forward end of a letter on the butt and an overlap judging arrangement for judging an overlap of letters based on the result of detection by the detector. The detector includes a light source for projecting light on the surface of a letter and a line sensor having a plurality of light receiving elements arranged in a line, wherein the line sensor detects a shadow of the forward end of the letters cast by the light source.

5 Claims, 13 Drawing Sheets

START
150
152
140a,b, OFF
NO
YES
154
130a,b, OFF
YES
NO
158
132a,b, OFF
YES
NO
159
142a,b, OFF
NO
YES
160
142a,b, OFF
NO
YES
162
132a,b, OFF
YES
NO
164
TIMER EXPIRED ?
NO
YES
166
134a,b, OFF
YES
NO
167
142a,b, OFF
NO
YES
168
134a,b, OFF
YES
NO
170
TIMER END
NO
YES
174
134a,b, OFF
YES
NO
176
TIMER END
NO
YES
180
ISSUE REJECT COMMAND
178
DETECTION OVER ?
NO
YES
END
182

OVERLAP DETECTION APPARATUS AND METHOD

CROSS REFERENCE TO RELATED APPLICATION

This is a continuation of U.S. application Ser. No. 09/082,525, filed May 21, 1998, now U.S. Pat. No. 5,984,303 the subject matter of which is incorporated by reference herein.

BACKGROUND OF THE INVENTION

The present invention relates to an apparatus such as a mail sorter for separating and classifying a plurality of letters and postcards (hereinafter sometimes referred to as the letters) in conveyance, or more in particular to an overlap detection apparatus for detecting a plurality of letters overlapped in conveyance.

In an apparatus for detecting overlapped letters in conveyance disclosed in JP-A-4-266349, at least a roller is applied to the letters in conveyance and thus the side of the letters in contact with the roller is delayed, so that an overlap is detected according to whether the length of the letters undergoes a change.

On the other hand, JP-A-7-172628 discloses a method of detecting an overlap from an upward warping of the tail end of the letter released from a guide by which it is deformed.

Further, according to the conventional methods described in JP-B-60-30617 and JP-B-30618, a space is formed by separating an outer belt from an inner belt at a bent portion of a conveyance path, and two light projectors/detectors located at different positions project light on the letters passing through the bent portion, thereby detecting an overlap according to whether the light is shut off by the forward end of a letter overlapped on the middle part of another letter.

SUMMARY OF THE INVENTION

According to the above-mentioned conventional methods, in the case where a letter and a postcard are overlapped, the shorter length of the postcard than that of the letter sometimes makes it impossible to detect the change in length even after the postcard is displaced.

In the method wherein the exterior of a letter is deformed by a guide and the warping upward of the tail end of the letter is detected after passing through a guide for detecting an overlap, on the other hand, a thin letter or a thin postcard which is low in rigidity is warped up too late or too low to detect after being deformed by the guide.

Further, in the method of judging an overlap from the fact that the light is shut off by the forward end of a letter overlapped on another using two light projectors/detectors, a thick letter or a letter liable to bent, even when not overlapped, may shut off the light in the middle part thereof, often leading to an detection error of judging a letter as overlapped. For preventing this detection error, the light axis is required to be at some distance from the letter surface. In that case, however, detection is impossible unless the forward end of one of the letters overlapped leads the other considerably, thereby making it impossible to attain a high detection efficiency.

The object of the present invention is to provide an apparatus and a method for accurately detecting any combination of letters, postcards, etc. overlapped in conveyance.

According to the present invention, there is provided an overlap detection apparatus comprising a separator having a bent conveyance path for deforming letters outward, wherein the inner and outer surfaces of the bent portion of the conveyance path are in spaced relation to each other so that letters can continue to proceed without being bent before contacting the outer surface of the bent conveyance path.

After that, each letter is bent by contacting the outer surface of the bent part of the conveyance path, and subsequently proceeds until the whole letter comes to bend in contact with the inner surface of the conveyance path.

As viewed from outside the bent portion, therefore, the letter surface advances outward until the forward end thereof comes into contact with the outer surface of the conveyance path, and then proceeds inward.

A letter overlapped on another, on the other hand, has the surface thereof directed inward temporarily, after which the forward end thereof proceeds again outward.

In view of this, an overlap detection apparatus according to the invention comprises detection means for detecting the surface state of a letter in the neighborhood of an outer surface area of the conveyance path where the forward end of the letter in conveyance first comes into contact, and overlap judging means for extracting and judging the above-mentioned features of an overlap from the detection result.

DESCRIPTION OF THE PREFERRED EMBODIMENTS

Figure 1:
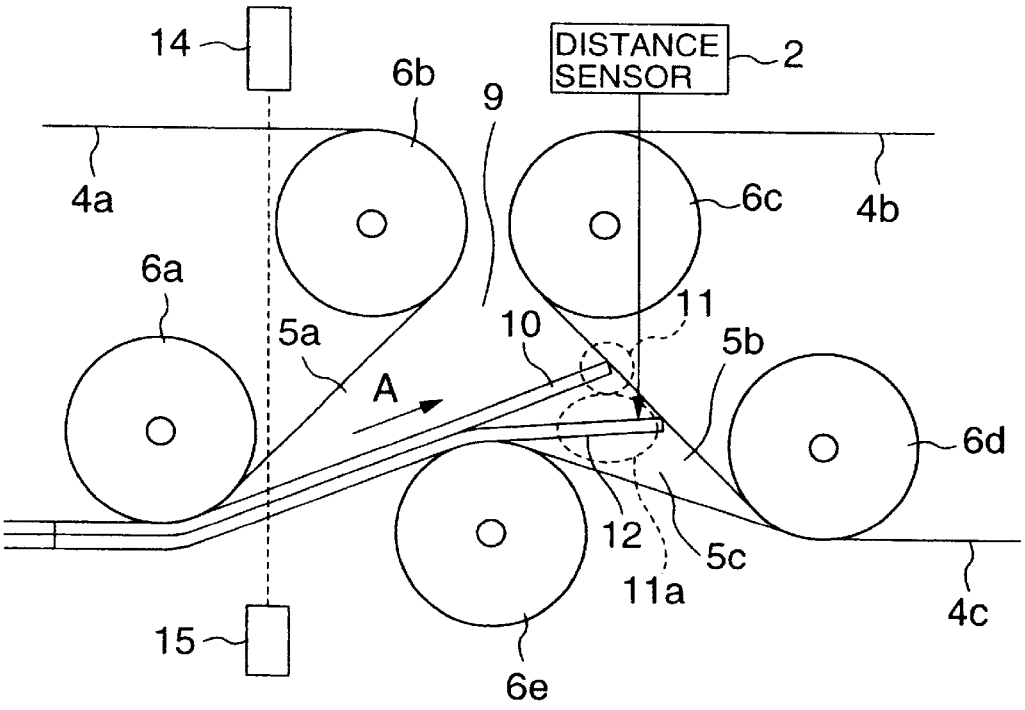
FIG. 1 is a side view of an overlap detection apparatus according to an embodiment of the invention.
Figure 2:
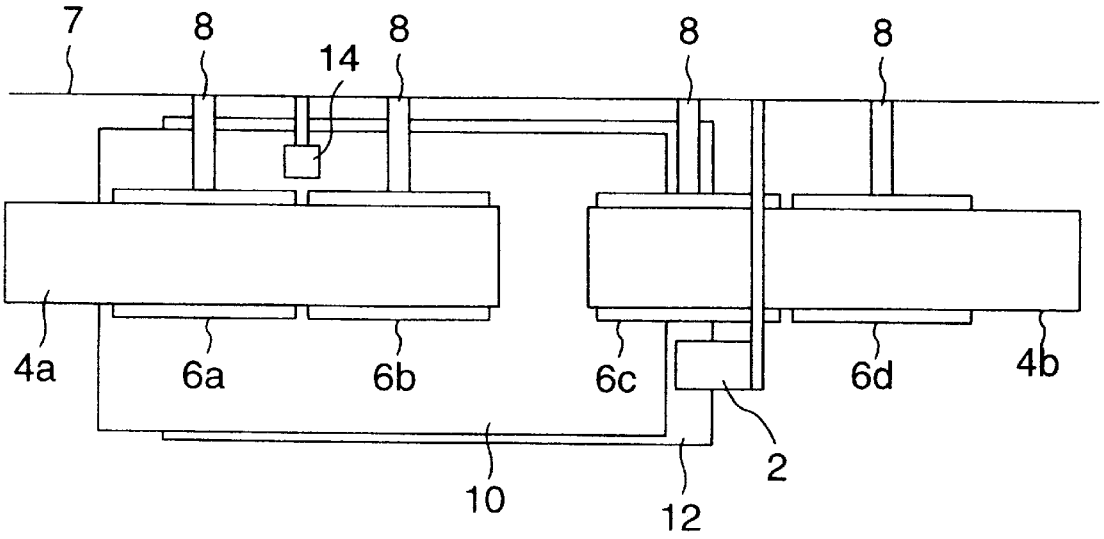
FIG. 2 is a top plan view of the overlap detection apparatus shown in FIG. 1.

FIG. 1 is a side view of an overlap detection apparatus according to an embodiment of the invention, and FIG. 2 is a top plan view of the overlap detection apparatus of FIG. 1.

Conveyor belts 4*a*, 4*b*, 4*c* are moved by driving rollers not shown for conveying, along the direction of arrow A, a plurality of letters separated one by one by a separator not shown.

The conveyor belts 4*a*, 4*b* constitute outer conveyance paths 5*a*, 5*b*, of separation means with guide rollers 6*a*, 6*b* and a guide roller 6*e*, respectively. The conveyor belt 4*c* and a guide roller 6*e*, on the other hand, make up an inner conveyance path 5*c* of the separation means including a letter release section extending from a point where the conveyor belts 4*a*, 4*c* cease to hold letters to a point where the conveyor belts 4*b*, 4*c* resume to hold letters.

Each guide roller is supported on a side plate 7 by a corresponding shaft 8.

The outer and inner conveyance paths of the separation means form a letter release section 9 where letters are not held as shown.

In order that at least an end of each letter in conveyance may be held at the forward and rear ends of the letter release section 9 for conveying the letters accurately, the length of the letter release section 9 along the direction of conveyance is set longer than the shortest mail allowed for the apparatus.

Passage sensors 14, 15, one of which emits light and the other receives light, change the output thereof as a letter interrupts the light and thus detect the arrival of a letter at the separation means. Detection means is a distance sensor 2, for example, using a laser beam for measuring the height and fluctuations of the height of the letter surface. The passage sensors 14, 15 and the distance sensor 2 are supported on the side plate 7 by support means.

As shown in FIG. 2, the conveyor belts hold a letter by the central portion thereof. Therefore, the distance sensor 2 and the passage sensors 14, 15 are arranged in the positions where the letter surface is not covered by the conveyor belts.

Two conveyor belts can be used for holding each letter by the ends thereof in parallel to the direction of conveyance in such a manner that the position sensor 2 can measure the letter surface from between the two conveyor belts.

Also, a butt 11 or the like can be configured of a large-sized roller to produce a similar effect.

FIG. 1 shows the state in which the forward end of the upper one of overlapped letters has come into contact with the butt 11 on the outer conveyance path.

In the case where two letters are overlapped as shown, the lower letter 12 first strikes the butt 11 and bends at a bending section 11*a*, followed by the upper letter 10 proceeding straight ahead to the butt 11. As a result, the overlapped letters are separated, one upward and the other downward, as shown in the neighborhood of the butt 11. The letter release section 9 releases the upper and lower letters from each other without holding them so as to separate them.

The distance from the detection means 2 to the letter surface in contact with the butt 11, as measured by the detection means 2, is shortest when the forward end of the letter first enters the measurement range and progressively decreases as the letter is bent and conveyed.

Figure 4:
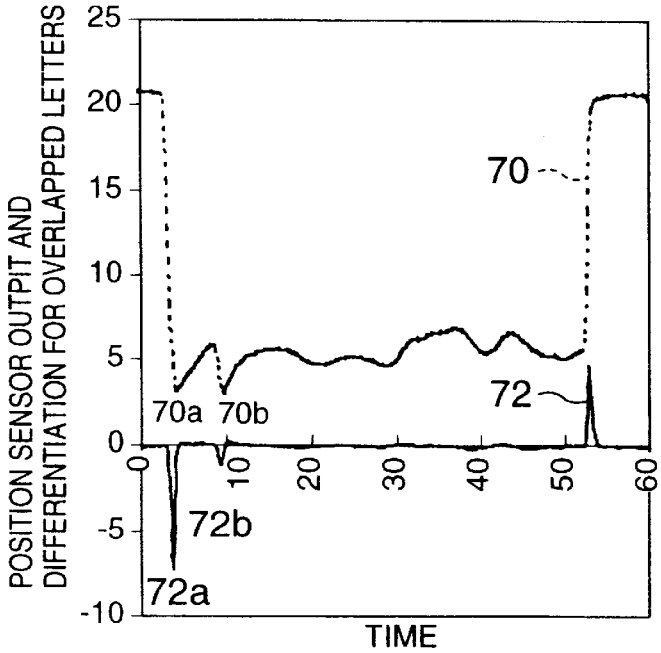
FIG. 4 shows an output waveform of a sensor and a differentiation thereof according to the position of the paper sheets or the like shown in FIG. 3.

For overlapped letters as shown in FIG. 1, the waveform of the distance sensor 2 has such a feature as represented by a curve 70 in FIG. 4. In FIG. 4, the ordinate represents the output of the distance sensor 2 with the lower portion of the screen nearer to the distance sensor 2, and the abscissa represents the time. The output of the distance sensor 2 and the time are plotted in units relative to each other.

Figure 3A:
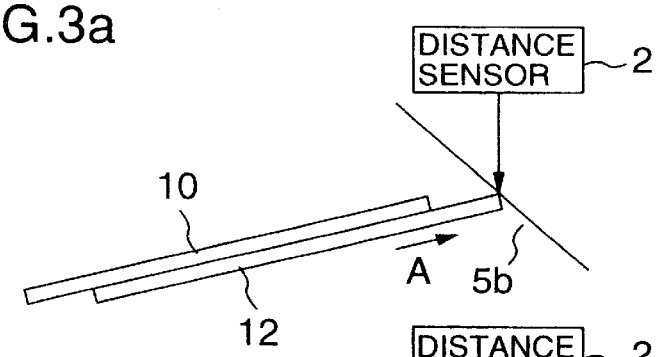
FIGS. 3*a*, 3*b*, 3*c* are diagrams showing relative positions of a distance sensor of an overlap detection apparatus and paper sheets or the like according to the present embodiment.
Figure 3B:
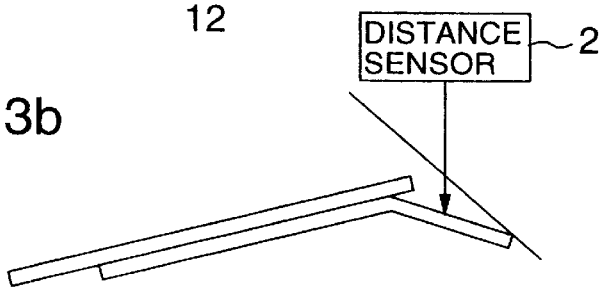
Figure 3C:
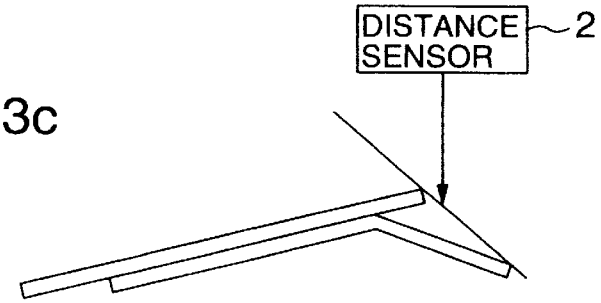

FIGS. 3*a*, 3*b*, 3*c* show the positions of the forward end of a letter corresponding to the output waveform of the distance sensor 2 shown in FIG. 4.

In FIG. 3*a*, at the time point when the lower letter 12 reaches the butt 11, the forward end thereof approaches the distance sensor 2 and a peak 72*a* in FIG. 4 is formed. After that, as shown in FIG. 3*b*, the letter is bent away from the distance sensor 2. At the time point when the upper letter 10 conveyed in overlapped state reaches the butt 11 as shown in FIG. 3*c*, however, the distance sensor 2 detects the surface of the upper letter and thus a peak 70*b* of FIG. 4 is formed.

In the case of a single separate letter, only one such a peak is formed immediately after starting the detection operation. In the presence of a plurality of peaks, therefore, an overlapped state is indicated.

The curve 72 in FIG. 4 represents a temporal differentiation of the curve 70. It is seen that a peak 72*a* appears upon detection by the distance sensor 2 of the forward end of the lower letter reaching the butt 11, and after that, a peak 72*b* appears upon detection of the forward end of the upper letter 10. An overlap is judged in the case where two peaks of not lower than a predetermined threshold value appear as described above. In this way, it is possible to detect an overlapped state positively.

Figure 5:
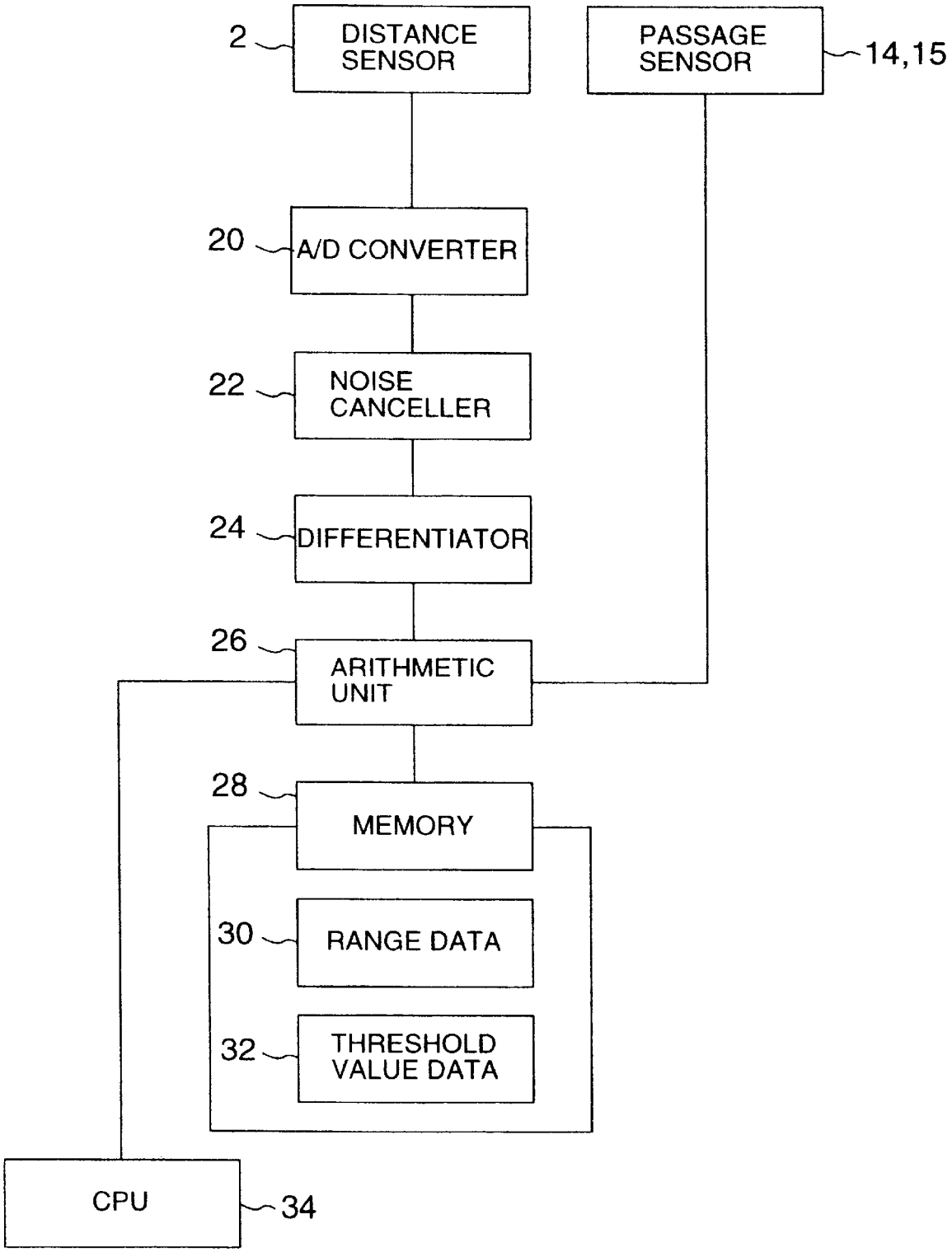
FIG. 5 is a diagram showing a circuit configuration of the overlap detection apparatus of FIG. 1.

FIG. 5 shows a configuration of an apparatus according to an embodiment of the invention.

The output of the distance sensor 2 is digitized through an A/D converter 20. The data is deprived of noise components by a noise canceller 22. The noise canceller 22 can be interposed between the distance sensor 2 and the A/D converter 20.

The digitized data are differentiated thereby to extract the peaks formed by the forward end of the letters as shown in FIG. 4. An overlap is judged by an arithmetic unit 26 based on this data.

The outputs of passage sensors 14, 15 are read by the arithmetic unit 26. The arithmetic unit 26 decides to fetch the data from the distance sensor 2 based on the signals thus read. The judgment on the presence or absence of an overlap made by the arithmetic unit 26 is applied to a central processing unit 34 for controlling the overall operation of an apparatus such as a mail sorter.

A memory 28 has stored therein threshold data 32 used by the arithmetic unit 26 for checking the data received from a differentiator 24, range data 30 for setting a range to be compared with a threshold value, a program for activating the arithmetic unit 26, and other data.

The operation of the noise canceller 22 and the differentiator 24 can be processed according to a program in the arithmetic unit 26. Also, the function of the arithmetic unit 26 can be performed alternatively by the central processing unit 34.

Figure 6:
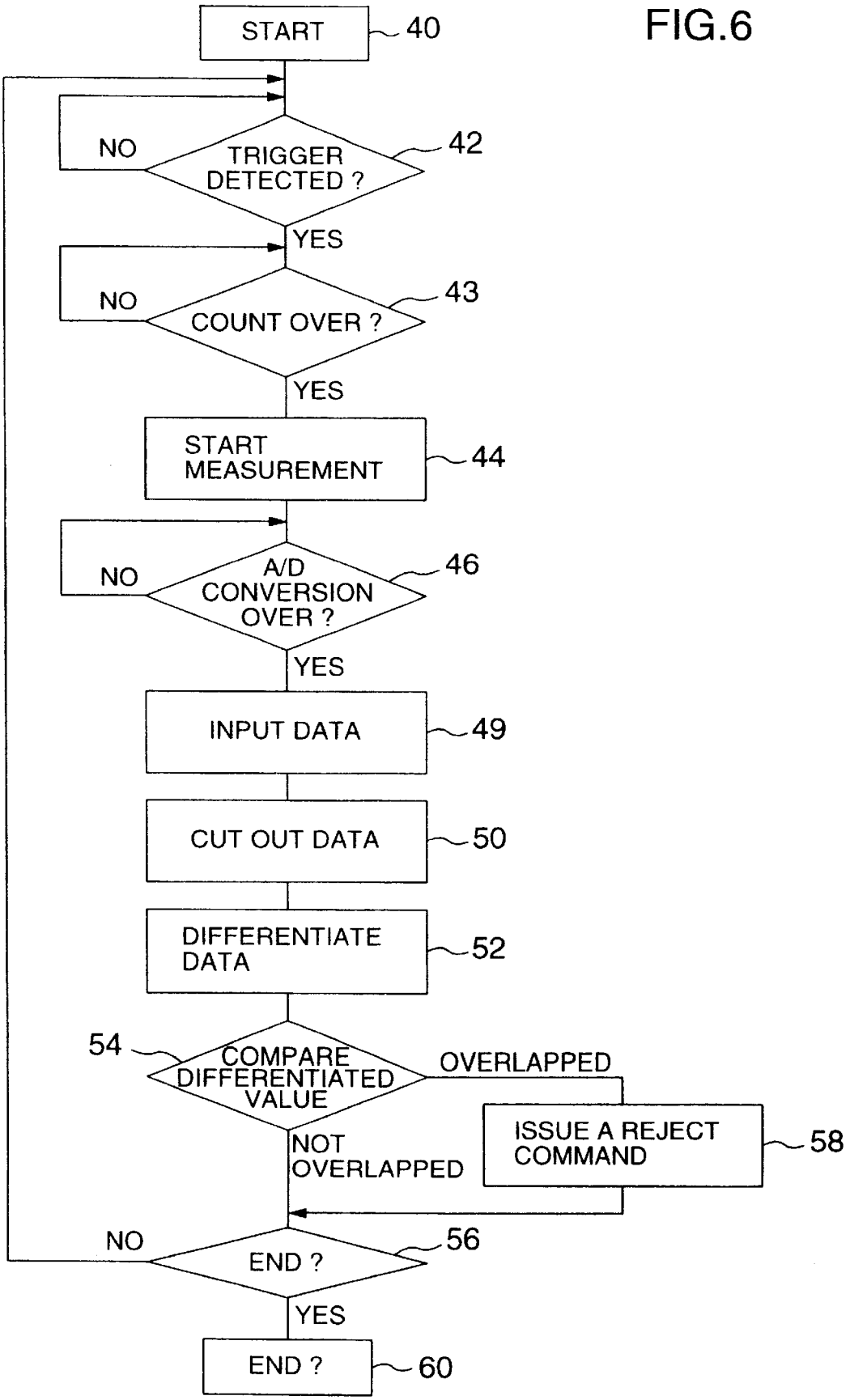
FIG. 6 is a flowchart for the operation of the overlap detection apparatus shown in FIG. 1.

FIG. 6 is a flowchart for the operation according to an embodiment of the invention.

When a command to start the operation of the overlap detection apparatus is issued from the central processing unit 34 or the like in step 40, a trigger signal from the passage sensors 14, 15 is waited for in step 42. A trigger signal is generated at the time point when a letter reaches the separation section and passes across the passage sensors 14, 15.

In the case where the distance sensor 2 is at a distance from the passage sensors 14, 15, the timer is operated to count the time until the forward end of the letter reaches the position on the butt 9 to be detected by the distance sensor 2 (step 43).

At the timing when the forward end of the letter reaches the position for detection by the distance sensor 2, the distance of the letter surface begins to be measured (step 44).

The output of the distance sensor 2 is deprived of noise components in the noise canceller 24 (step 45). After that, the signal is temporally differentiated in step 46, and the data thus differentiated are applied to the arithmetic unit 26 (step 49).

For extracting the peaks formed by the forward end of a letter, the signal is temporally differentiated by reason of the fact that in the case of an uneven letter with different parts thereof having different thicknesses, the distance between the distance sensor 2 and the letter surface may be shortened again after passage of the forward end of the letter. In such a case, judgment of the distance between the letter surface and the distance sensor 2 only by comparison with a threshold value makes it impossible to discriminate between the forward end of the upper letter and the change in the thickness of the letter, often leading to a detection error. The behavior of the forward end of the letter causes a steeper change of the distance from the distance sensor 2 than the difference in thickness of the letter. Therefore, temporal differentiation makes it possible to discriminate an overlapped state positively by producing a large value only for the change in the distance from the forward end of the letter.

In the arithmetic unit 26, only a predetermined range is cut out as the forward end of the letter (step 50), the distance in the particular range is compared with an arbitrary threshold value (step 54), and upon detection of a peak considered to represent the forward end of another letter after passage of the forward and of the preceding letter, an overlap is judged and a reject command is issued to the central processing unit 34 to remove the particular letter from the conveyance path (step 58).

In the case where an allowable letter length is preset for the whole apparatus, every letter longer than a predetermined length is removed. Therefore, in the case where the difference along the direction of conveyance between the forward end of a first letter and the forward end of a following letter overlapped on the first letter exceeds a predetermined range of length, then, the letters are removed for the abnormal length thereof. Since a range can be specified in which the forward end of an overlapped letter is detected, it is meaningless to process the information beyond the particular range. For saving the processing time and eliminating the judgment error due to the unnecessary information, therefore, a predetermined range is preferably cut out.

Step 56 judges whether a termination command is issued from the central processing unit 34. In the absence of such a command, trigger signal from the passage sensors 14, 15 is awaited for detecting an overlapped state again.

In response to a termination command, if any, from the central processing unit 34, the operation is terminated.

According to this embodiment, letters are forcibly pressed against the butt 11 and bent by the outer conveyance path. As compared with the case of JP-A-7-172628 in which the rigidity of the letter is depended on, therefore, even a thin letter with a low rigidity can be positively bent and the vertical distance between the two overlapped letters can be increased to make detection possible.

Figure 7:
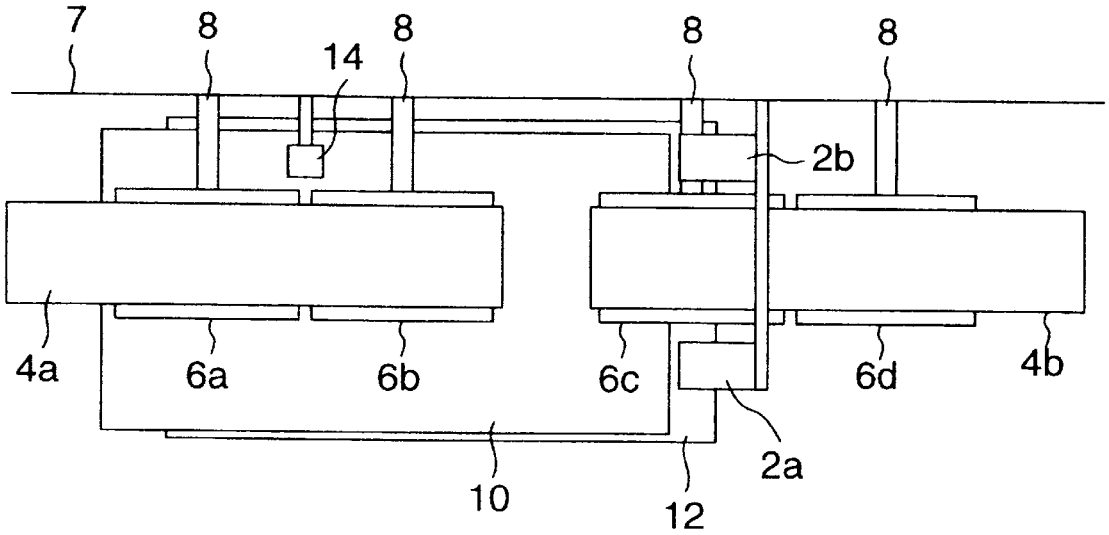
FIG. 7 shows an overlap detection apparatus according to a second embodiment of the invention.
Figure 8:
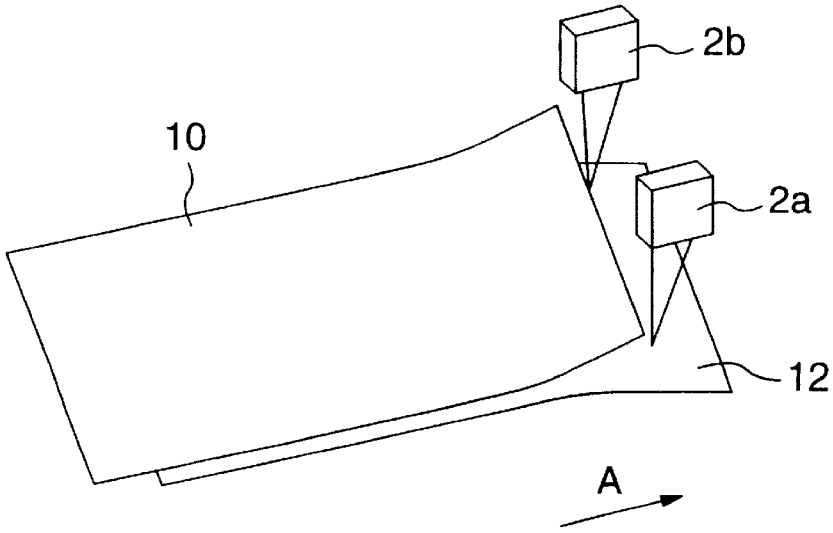
FIG. 8 is a perspective view showing an arrangement of a distance sensor of the overlap detection apparatus of FIG. 7.

FIG. 7 shows an overlap detection apparatus according to a second embodiment of the invention. FIG. 8 is a perspective view showing an arrangement of the distance sensors of FIG. 7.

The difference of this embodiment from the embodiment of FIG. 1 lies in distance sensors 2*a*, 2*b* arranged in such positions as to detect the two forward corners of a letter in the direction perpendicular to the direction of letter conveyance.

A position sensor utilizing the reflected light develops a noise when the reflectivity of the letter surface changes due to different characters or colors. In many cases, noises of different decibels are generated at different timings for different positions on the letter surface. The peak due to the forward end of the upper one of overlapped letters is generated substantially at the same time for the two distance sensors arranged across the conveyance path. The outputs of the two distance sensors arranged transversely of the conveyance path are compared with each other, and only in the case where the peaks thereof are coincident with each other, the data are extracted to judge an overlap. As a result, the chance of a detection error due to noises is reduced.

The distance sensors can alternatively be arranged at different positions along the direction of conveyance on both sides of the conveyance path. In such a case, one distance sensor measures the letter surface at the butt 11, and the other sensor measures the position where the letter is held. Even in the case here the reflectivity of the letter surface undergoes a change which is a cause of noises, the two distance sensors produce substantially the same output waveform if the position of reflectivity change is the same for the two distance sensors arranged transversely of letter conveyance path. The peak due to the forward end of the upper one of letters conveyed in overlapped state is detected only by the distance sensor for measuring the butt 11. Determining the difference between the outputs of the two distance sensors, therefore, can detect only the peak due to the forward end of the upper one of the overlapped letters, thereby reducing the chance of erroneous detection due to noises.

Figure 9:
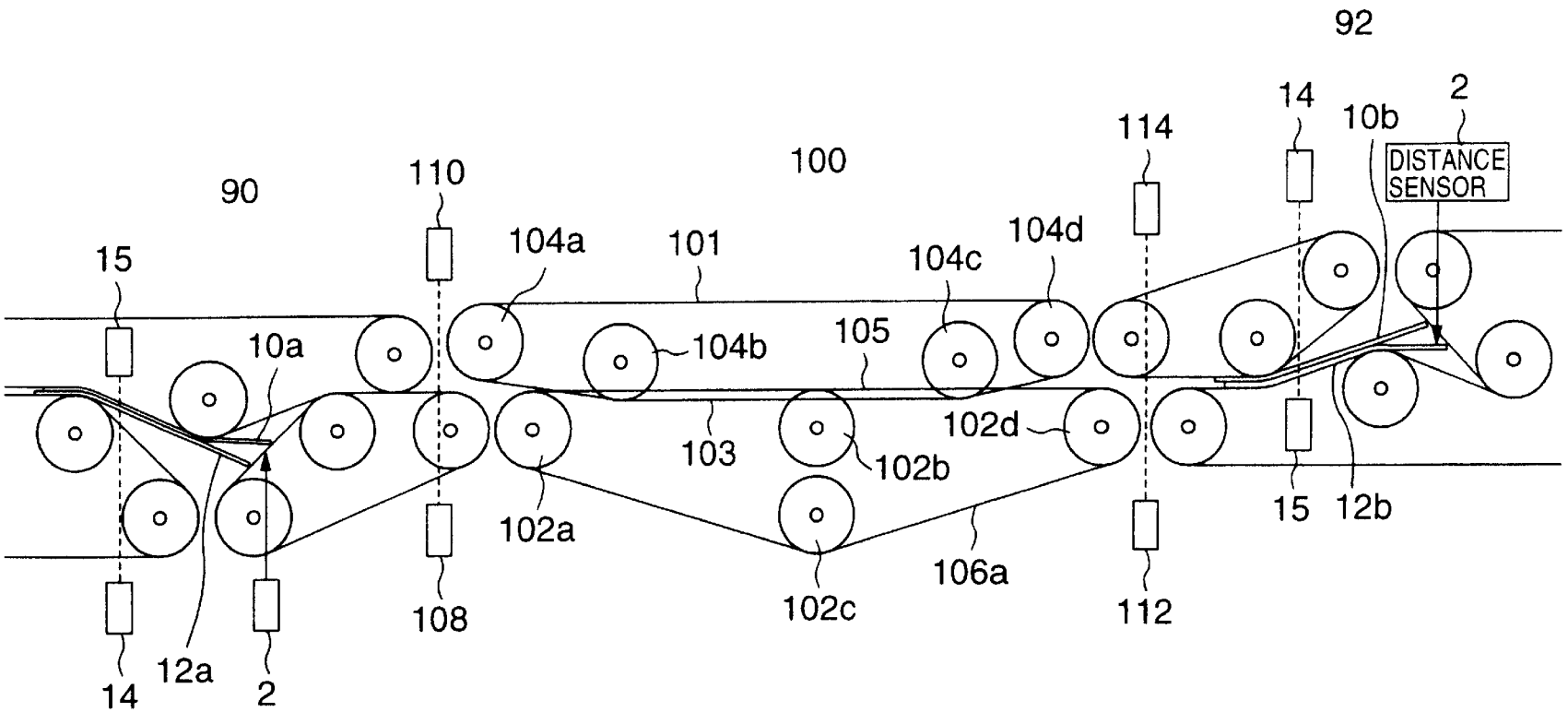
FIG. 9 shows an overlap detection apparatus according to a third embodiment of the invention.
Figure 10:
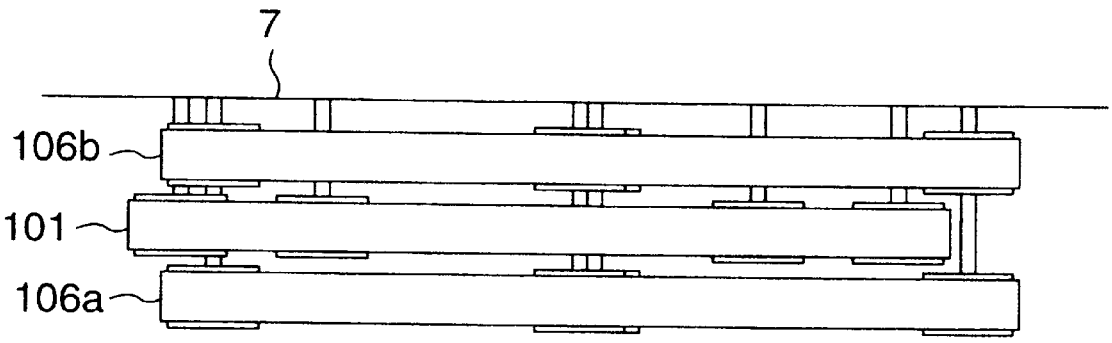
FIG. 10 is a top plan view of the overlapped letter displacement unit shown in FIG. 9.

FIG. 9 is a diagram showing a third embodiment of the invention, and FIG. 10 is a top plan view of an overlapped letter displacer 100 according to this embodiment.

Letters conveyed in overlapped state, after passing a first overlap detector 90 in which the letter is bent in the opposite direction to that for the overlap detector according to some of the above-mentioned embodiments, pass through the overlapped letter displacer 100 and then a second overlap detector 92 having a similar configuration as some of the embodiments described already.

The first overlap detector 90 detects overlapped letters with the lower letter 12*a* arriving later than the upper letter 10*a*, and the second overlap detector 92 detects overlapped letters with the upper letter 10*b* arriving later than the lower letter 12*b*.

The overlapped letter displacer 100 includes two conveyor belts 106*a*, 106*b* for supporting the letters at the transversal ends thereof, and a conveyor belt 101 interposed between the conveyor belts 106*a*, 106*b* for pressing the letters against the conveyor belts 106*a*, 106*b*.

The conveyor belts 106*a*, 106*b* are supported on guide rollers 102*a*, 102*b*, 102*c*, 102*d*, and the conveyance belt 101 on guide rollers 104*a*, 104*b*, 104*c*, 104*d*. Some of the guide rollers are rotated by conveyance means not shown thereby to drive the conveyor belts. The conveyance surface 103 of the conveyor belt 101 is located lower than the conveyance surface 105 of the conveyor belts 106*a*, 106*b*. Letters are pressed against the conveyance surfaces thereby to generate a conveyance force.

The conveyance speed of the conveyor belt 101 is lower than that of the conveyor belts 106*a*, 106*b*, so that the upper letter 10 lags behind another letter conveyed in overlapped state therewith. Also, the coefficient of friction of the conveyor belt 101 is set lower than that of the conveyor belts 106*a*, 106*b*. This is by reason of the fact that a higher coefficient of friction of the conveyor belt 101 would delay the conveyance of a single letter.

Passage sensors 108, 110 are arranged upstream of the overlapped letter displacer 100 along the direction of conveyance for measuring the time when letters pass between them. Also, passage sensors 112, 114 are arranged downstream along the direction of conveyance for measuring the time when letters pass between them after the overlapped letter displacer 100. In the case where letters are overlapped, the upper letter is delayed by the conveyance belt 101 and the resultant change in length lengthens the time taken after passing through the overlapped letter displacer 100. The difference is detected to judge an overlap.

With an overlap detection apparatus for detecting overlapped letters by separating them from each other, the overlapped state cannot be easily detected in the case where the forward end of one letter is not displaced considerably from that of the other letter. The overlap detection by displacing the overlapped letters from each other, on the other hand, is possible by detecting the change in length due to the displacement even when the difference in length is small between the upper and lower letters. Also, with the configuration according to this embodiment, even a very small displacement between the forward ends of letters which cannot be detected by the overlap detector 90 located upstream in the direction of letter conveyance can be detected by the next overlapped letter displacer 100, or if impossible to detect by the displacer 100, can be positively detected by the next overlap detector 92 where the letters are further displaced in such a direction as to make the detection easier.

On the other hand, assume a apparatus for detecting overlapped letters of the same length in which the lower letter 12*a* is liable to lead the upper letter 10*a*. The lower letter 12 lags and the whole length of the overlapped letters is shortened. With a further displacement, however, the forward end of the upper letter 10*a* leads and the whole length of the overlapped letters increases. Depending on the initial displacement between the upper and lower letters at the inlet of the overlapped letter displacer 100 or the amount of displacement by the overlapped letter displacer 100, therefore, the difference of displacement measurements is so small between the passage sensors 108, 110 and the passage sensors 112, 114 that an overlap cannot be judged.

With the increase in the speed of the conveyor belt 101, however, the leading lower letter 12*a* further leads the upper letter. Therefore, the whole length of the overlapped letters changes positively after passing through the overlapped letter displacer 100, thereby making detection possible. For this reason, with an apparatus in which the lower letter 12*a* is liable to lead the upper letter 10*a*, the conveyor belt 101 is preferably moved faster than the conveyor belts 106*a*, 106*b*.

Figure 11:
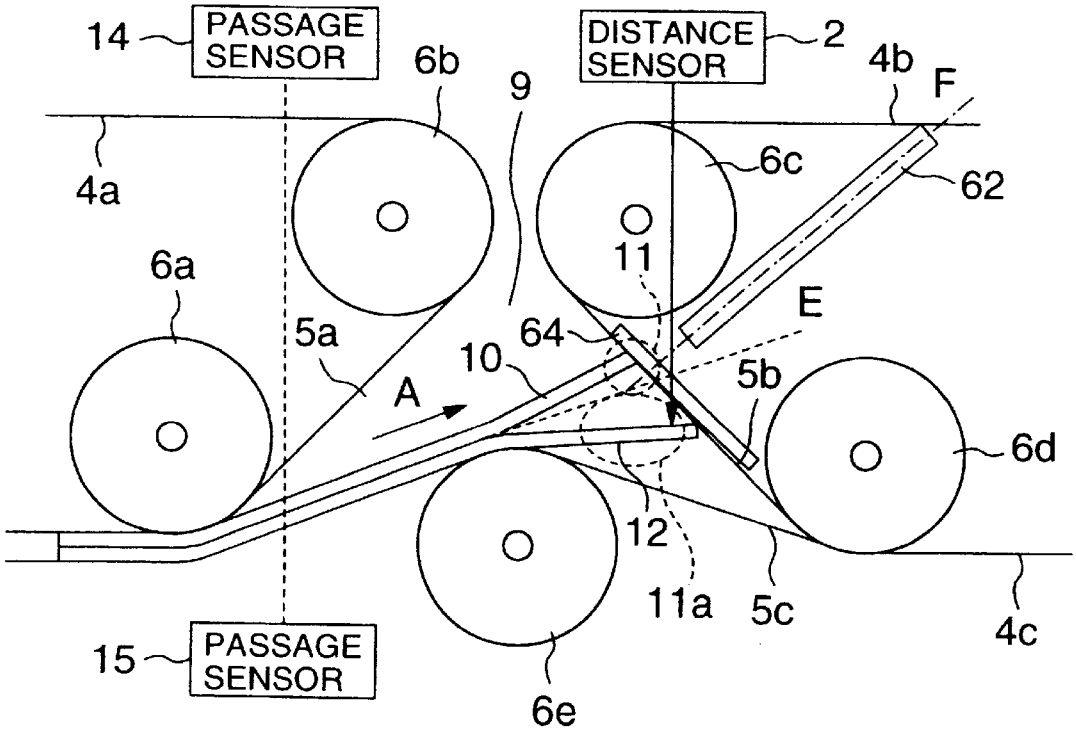
FIG. 11 is a side view of an overlap detection apparatus according to a fourth embodiment of the invention.
Figure 12:
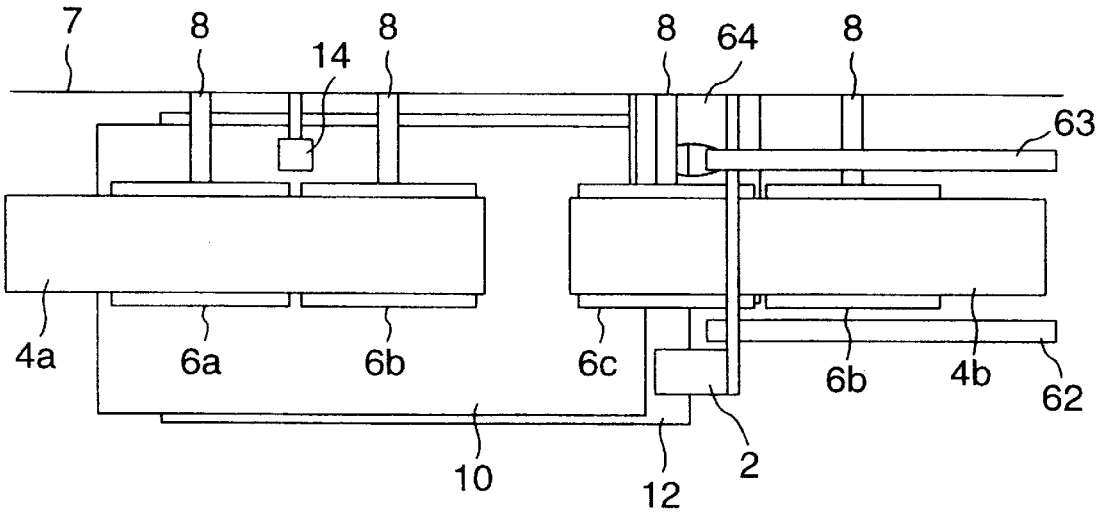
FIG. 12 is a top plan view of the overlap detection apparatus shown in FIG. 11.

FIG. 11 is a side view showing an overlap detection apparatus according to an embodiment of the invention, and FIG. 12 is a top plan view of the overlap detection apparatus of FIG. 11.

The embodiment of FIG. 11 is different from the embodiment of FIG. 1 in air nozzles 62, 63. The air nozzles 62, 63 are made of a hollow cylinder for blowing air out of the forward end thereof by air supply means not shown.

The air nozzles 62, 63 are arranged on the two sides of the conveyor belt 4*b*. Further, the air nozzles 62, 63 are arranged in such positions that an extension F of the direction in which air is blown out intersects a locus E of letter conveyance up to the butt 11 in the neighborhood of the butt 11.

As a result, the air blown out of the air nozzles 62, 63 flows upstream in the direction of conveyance toward the letter surface from the outer conveyance path.

Since the direction of air blow is set in this manner, when the forward end of the lower letter 12 leading the other one of overlapped letters approaches the outer conveyance path 5*b* on the butt 11, the air blown out of the nozzles 62, 63 proceeds along the letter surface between the upper and lower letters, with the result that the upper letter 10 is pushed up in FIG. 11.

Consequently, both the peak 70*b* of the waveform measured by the distance sensor 2 and the peak 72*b* of the differentiation thereof shown in FIG. 4 increase to such an extent that an overlapped state can be detected without fail. Also, the threshold for judgment can be raised (lowered in the negative direction in FIG. 4). Thus the peaks that may occur due to the unevenness of the letter surface or vertical fluctuations of the waveform due to the image are not mistaken for an overlapped state, thereby making it possible to reduce the error of detecting a single letter as an overlap.

This embodiment is also different from that of FIG. 1 in the provision of a belt guide 64. The belt guide 64 is arranged along the conveyor belt 4*b* on the butt 11 to prevent the conveyor belt 4*b* from being displaced when a letter comes into contact with the conveyor belt 4*b* on the butt 11.

The displacement of the conveyor belt 4*b* depends on the hardness and weight of the letter. The displacement of the conveyor belt 4*b* changes the conveyance route of the letter and differentiates the time for different types of letters to pass through the overlap detection apparatus. The provision of the belt guide 64 reduces the displacement of the conveyor belt 4*b* and hence the variations of the time when different types of letters pass through the overlap detection apparatus.

On the other hand, the air nozzles 62, 63 are arranged taking the displacement of the conveyor belt 4*b* into account so that the conveyor belt 4*b* may not be contacted by letters. In the presence of the belt guide 64, however, the displacement of the conveyor belt 4*b* need not be taken into account, and the outlets of the air nozzles 62, 63 can be placed nearer to the conveyor belt 4*b*. As a result, the upper letter 10 can be separated to a greater extent taking advantage of the rapid flow of the air in the neighborhood of the outlets of the air nozzles 62, 63, thus making accurate overlap detection possible.

Figure 13:
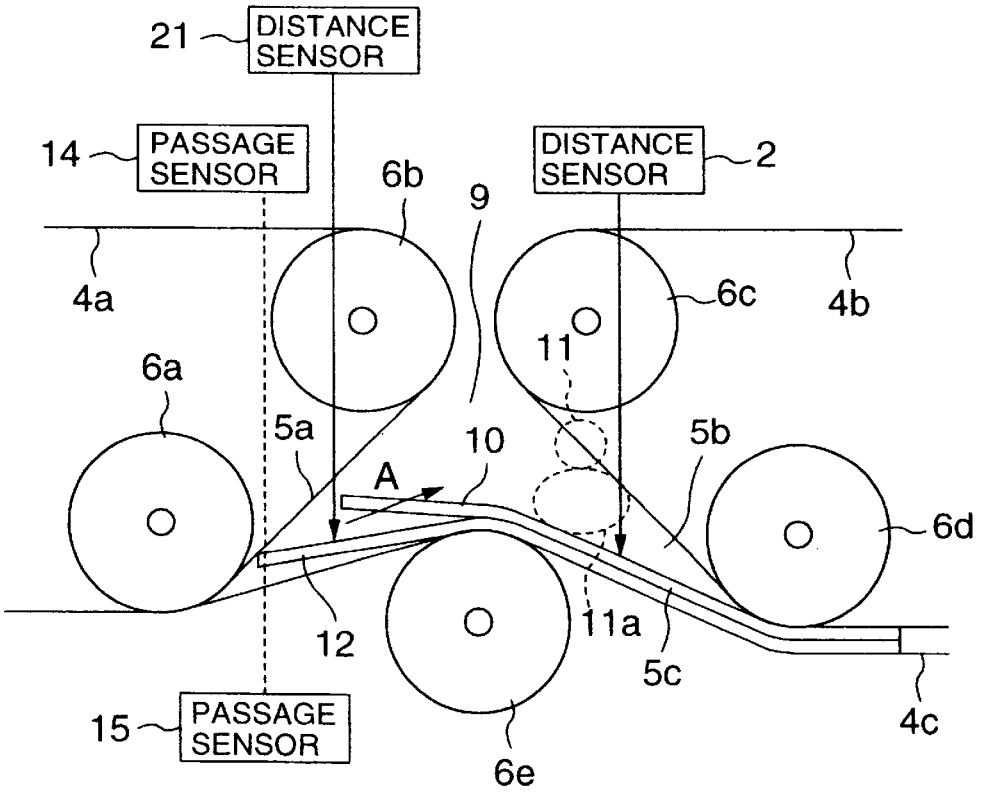
FIG. 13 is a side view of an overlap detection apparatus according to a fifth embodiment of the invention.

FIG. 13 is a side view of an overlap detection apparatus according to an embodiment of the invention.

This embodiment is different from the embodiment of FIG. 1 in the provision of a distance sensor 21 for measuring the distance change of the letter surface upstream in the direction of conveyance in the letter release section 9 of the separation means.

Figure 14:
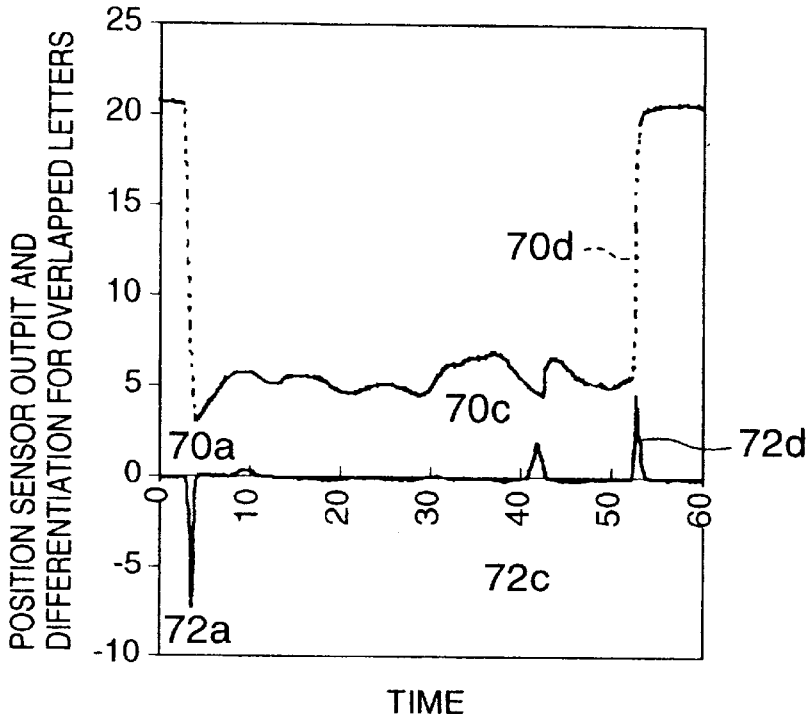
FIG. 14 is an example output of the distance sensor included in the embodiment shown in FIG. 13.

FIG. 14 shows a distance waveform and a differentiation thereof in the case where the overlapped letters shown in FIG. 13 are measured by the distance sensor 21. The tail end of the upper letter 10, upon arrival at the letter release section 9, approaches the distance sensor 21 thereby to form a peak 70*c*. After that, with the passage of the tail end of the lower letter 12, a leading edge 70*d* of the waveform appears. The differentiation of this waveform generates peaks 72*c*, 72*d* on positive side.

In the case where letters being conveyed are overlapped, the peak 72*c* is formed before the peak 72*d* with the passage of the letters. An overlapped state can thus be detected by checking for the peak 72*c*.

With the overlap detection apparatus shown in FIG. 1, unless the forward end of the upper letter 10 is displaced to some degree downstream of the conveyance direction from the forward end of the lower letter 12, the unevenness between the forward ends of the overlapped letters is very small, and so is the peak 72*b* of the differentiation curve in FIG. 4, with the result that it is sometimes impossible to judge an overlap.

According to this embodiment, even when the forward end of the upper letter 10 is not much displaced from that of the lower letter 12, an overlap can be detected with a higher probability as long as the tail end of the upper letter 10 is displaced in the direction of conveyance from the tail end of the lower letter 12.

Figure 15:
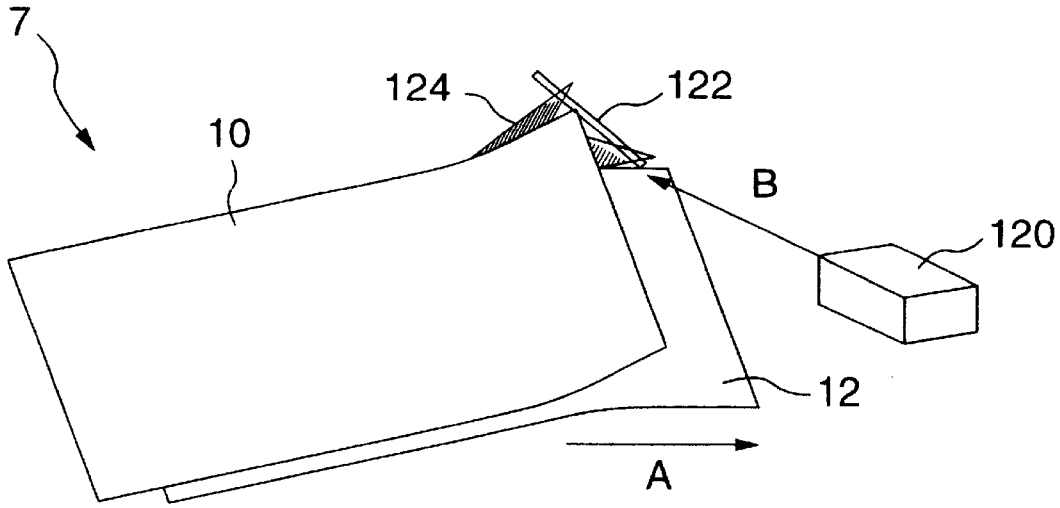
FIG. 15 is a detection means according to an embodiment of the present invention.

FIG. 15 shows a detection means according to an embodiment of the invention. This diagram shows the state in which the upper and lower letters 10, 12 have reached the butt 11 in the overlap detection apparatus of FIG. 1. In FIG. 15, the rollers, belts and the like are not shown.

A light source 120 projects light upstream in the direction of letter conveyance along the arrow B from the upper letter 10 side toward the side plate 7. A line sensor 122 is arranged on the side plate 7 in such a position as capable of detecting a shadow 124 of the overlapped letters 10, 12 cast by the light source 120.

Figure 16:
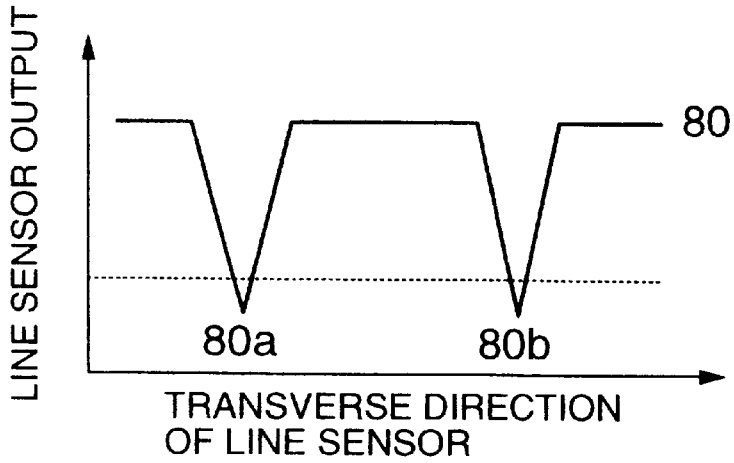
FIG. 16 is an example output of a line sensor included in the embodiment of FIG. 15.

FIG. 16 is a diagram showing an output waveform 80 produced by the line sensor 122 when the overlapped letters, upon arrival at the butt 11, cast a shadow on the line sensor 122. The ordinate represents an output voltage with the light quantity increasing upward. The abscissa represents the direction of scanning by the line sensor 122.

In the case where letters in conveyance are overlapped, the forward ends of the letters are separated from each other by the butt 11 upward and downward respectively. Therefore, two shadows are cast within the time required for conveying a single letter, so that two low-voltage portions 80*a*, 80*b* appear in the output waveform 80. For a single letter, on the other hand, only one shadow is cast and only one low-voltage portion appears. Overlapped letters can be detected by detecting these two low-voltage portions.

The detection means according to this embodiment, for lack of a distance sensor, can be improved in detection accuracy without adversely affecting the noises caused by the change in the colors or characters on the letter surface.

Figure 17:
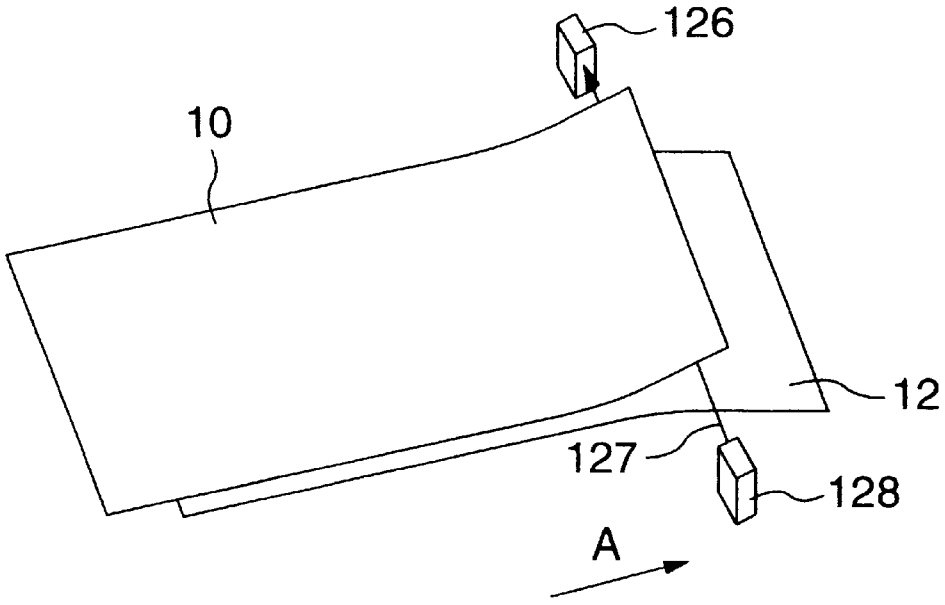
FIG. 17 shows a detection means according to a second embodiment of the invention.

A detection means according to another embodiment is shown in FIG. 17.

FIG. 17 shows the state in which the upper and lower letters have reached the butt 11 in the overlap detection apparatus shown in FIG. 1. In FIG. 17, rollers, belts and the like are not shown.

Passage sensors 128, 126 have a light path 127 substantially parallel to the surface of the letter conveyance path and substantially perpendicular to the direction of conveyance, which light path 127 transverses the butt 11.

Figure 18:
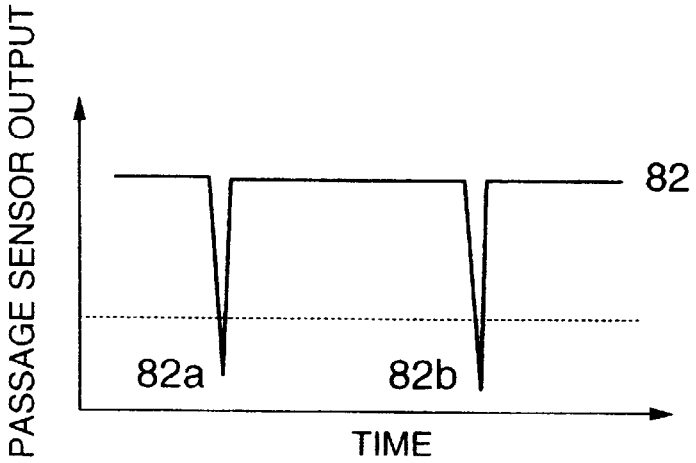
FIG. 18 shows an example output of a passage sensor included in the embodiment shown in FIG. 17.

FIG. 18 is a diagram showing a waveform 80 produced by the passage sensors 128, 126 when the overlapped letters have reached the butt 11 and have passed across the light path 127 of the passage sensors 128, 126. The ordinate represents an output voltage, and the abscissa the time.

The forward ends of letters, if overlapped, are separated from each other upward and downward respectively on the butt 11 and move along the conveyance path 5*b*. These two letters, while passing across the light path of the passage sensors 128, 126, generate two low-voltage portions 82*a*, 82*b* in the output waveform 82 within the same time as required for conveying a single letter. With a single letter, only one forward end of the letter is detected and only one low-voltage portion develops. Overlapped letters can be detected by detecting the two low-voltage portions. In spite of the foregoing description of the case in which the voltage of the passage sensors drop when the light path thereof is crossed by a letter as an example, the invention is applicable with equal effect to the case where the voltage rises when the light path of the passage sensors is crossed by a letter.

The detection means according to this embodiment uses passage sensors whose output remains unchanged under various colors or characters on the letter surface unlike the distance sensor. Also, overlapped letters can be detected less expensively.

Figure 19:
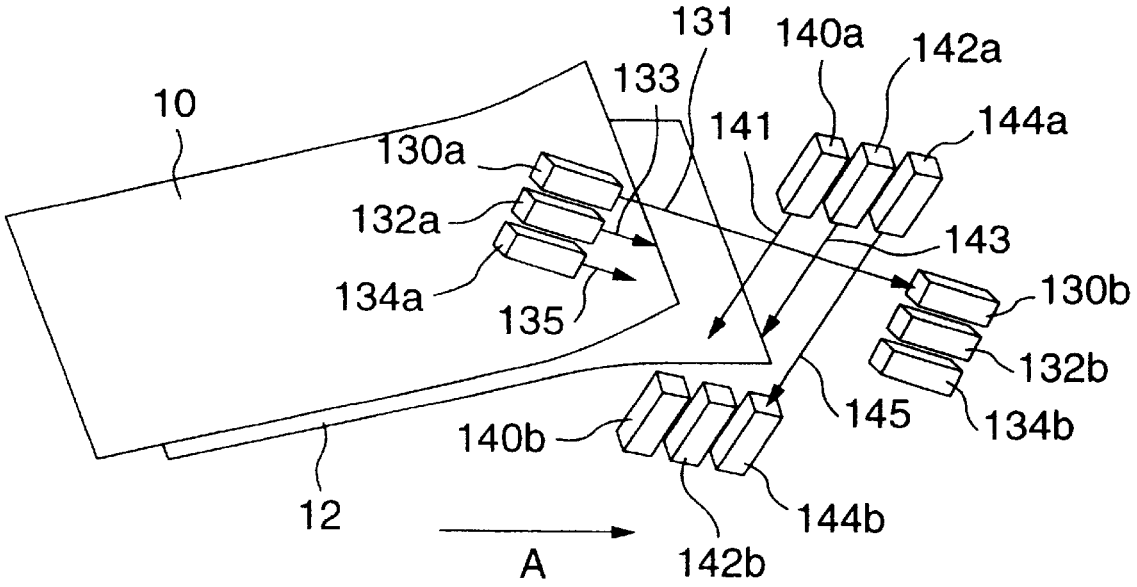
FIG. 19 shows a detection means according to a third embodiment of the invention.
Figure 20:
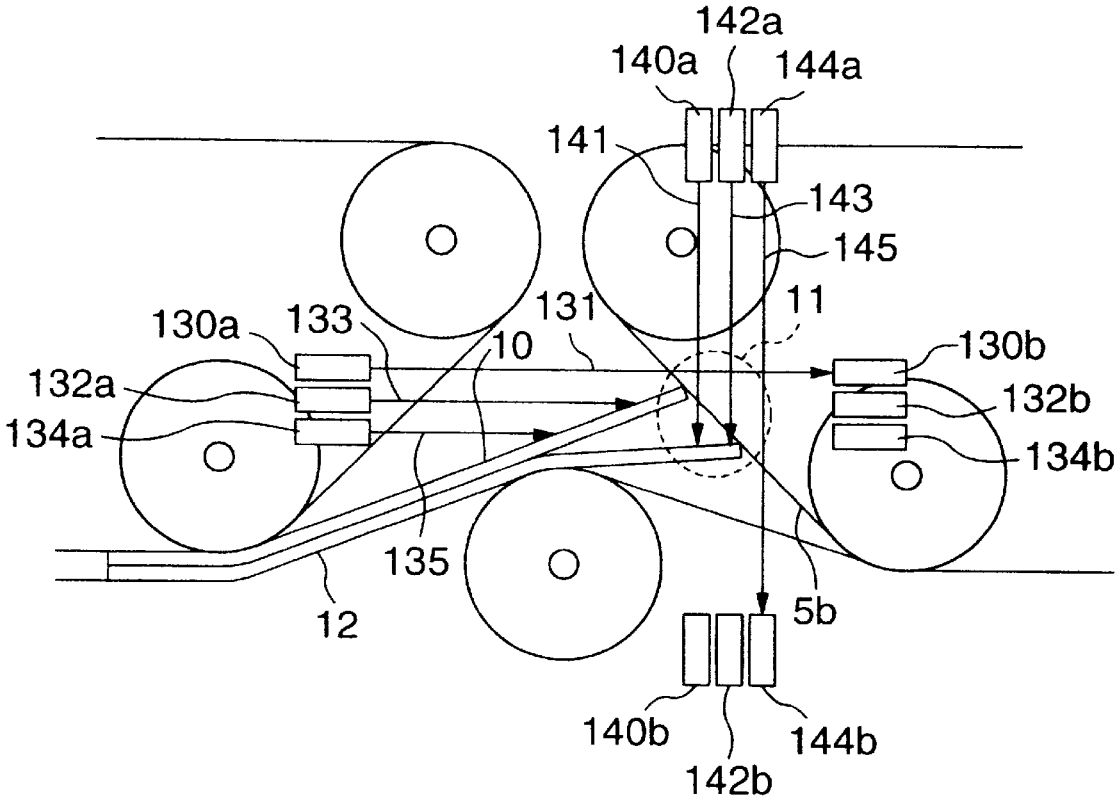
FIG. 20 is a side view of the detection means shown in FIG. 19.

FIG. 19 shows a detection means according to a third embodiment of the invention, and FIG. 20 a side view thereof.

This diagram shows the state in which the upper and lower letters 10, 12 have reached the butt 11 in the overlap detection apparatus of FIG. 1. In FIG. 19, the rollers, belts and the like are not shown.

Passage sensors 134*a*, 134*b*; 132*a*, 132*b*; 130*a*, 130*b*; and 140*a*, 140*b*; 142*a*, 142*b*; 144*a*, 144*b* are arranged on a plane substantially perpendicular to the surface of the letter conveyance path. The passage sensors 134*a*, 134*b*; 132*a*, 132*b*; 130*a*, 130*b* have light paths 135, 133, 131, respectively, in the direction of letter conveyance, while the passage sensors 140*a*, 140*b*; 142*a*, 142*b*; 144*a*, 144*b* have light paths 141, 143, 145, respectively, substantially perpendicular to the light paths 135, 133, 131. Each set of the passage sensors has an emission side and a detection side.

The light path 135 of the passage sensors 134*a*, 134*b* is located at least above the inner conveyance path 5 in FIG. 19. The passage sensor sets 132*a*, 132*b*; 130*a*, 130*b* detect different heights from each other. The passage sensor sets 140*a*, 140*b*; 142*a*, 142*b*; 144*a*, 144*b*, on the other hand, are adapted to detect different positions from each other along the direction of letter conveyance.

The passage sensors are arranged in such positions that the light path 133 of the passage sensors 132*a*, 132*b*, the light path 141 of the passage sensors 140*a*, 140*b*, the light path 135 of the passage sensors 134*a*, 134*b*, and the light path 143 of the passage sensors 142*a*, 142*b* intersect each other in the neighborhood of the conveyance path surface 5*b*.

Figure 21:
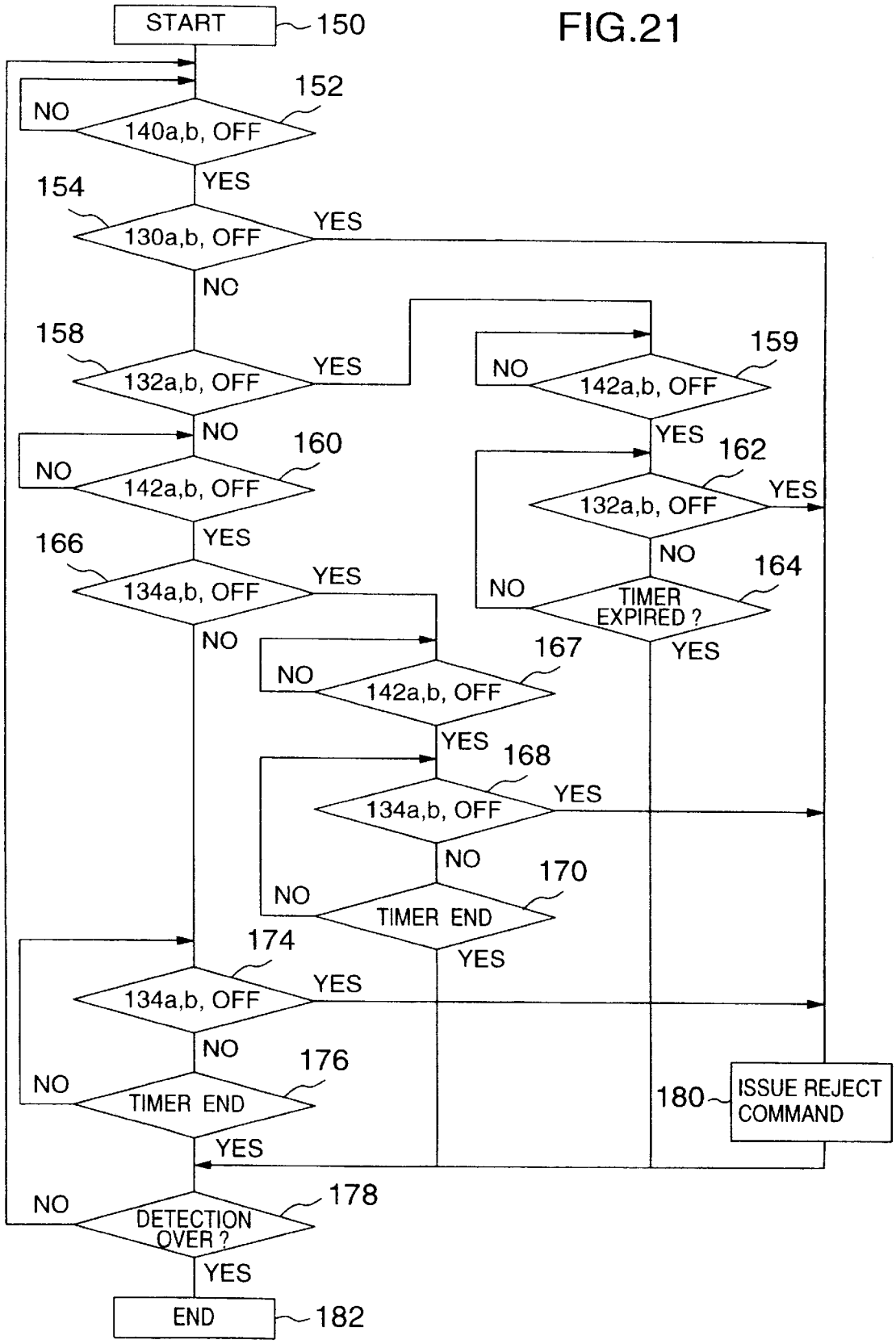
FIG. 21 is a flowchart for the operation of the detection means shown in FIG. 19.

FIG. 21 is a flowchart for explaining the operation of the detection means shown in FIG. 19.

When a command is issued for detecting overlapped letters from a central processing unit (step 150), the detection means stands by until the passage sensors 140*a*, 140*b* for detecting the letter position most upstream in the direction of conveyance detect the forward end of a letter (step 152). After checking the forward end of a letter, the state is checked of the passage sensors 130*a*, 130*b* located most upstream for detecting the letter height (step 154).

The light path 131 of the passage sensors 130*a*, 130*b* is set to a level somewhat higher than the height of the thickness letter allowed for the apparatus. Therefore, no single letter is passed across the light path 131. In the case where a letter passes across the light path 131 of the passage sensors 130*a*, 130*b*, therefore, another letter is considered to be overlapped on the probably thick first letter, so that the letters are strongly bent with the upper letter bent considerably upward by the roller 6*a*. In the case where the passage sensors 130*a*, 130*b* turn off, therefore, an overlap is judged and a reject command is issued (step 180).

In the case where the passage sensors 130*a*, 130*b* are on, on the other hand, the vertical end of the letter involved is detected by the passage sensors 132*a*, 132*b* located lower (step 158).

Once the forward end of the letter is confirmed, the letter is considered to have such a thickness that the forward end thereof reaches a point where the light path 133 of the passage sensors 132*a*, 132*b* intersects the light path 141 of the passage sensors 140*a*, 140*b*. After that, the apparatus stands by until the forward end of the letter reaches the passage sensors 142*a*, 142*b* located downstream in the direction of conveyance (step 159). After the forward end of the letter reaches the passage sensors 142*a*, 142*b*, the state of the passage sensors 132*a*, 132*b* is checked (step 162). In the case where the light path 133 of the passage sensors 132*a*, 132*b* is transversed by a letter again, an overlap is a probable result. Thus, a reject command is issued (step 180). An assumed temporal range of letter displacement is set by a timer (step 164), and the detection operation is continued for the particular temporal range.

In the case where the forward end of a letter along the height thereof is not detected in the passage sensors 132*a*, 132*b*, the apparatus stands by until the forward end of the letter reaches the passage sensors 142*a*, 142*b* downstream in the direction of conveyance (step 160). Once the forward end of the letter reaches the passage sensors 142*a*, 142*b*, step 166 judges whether the light path 135 of the passage sensors 134*a*, 134*b* is transversed by the letter.

In the case where the forward end of a letter is confirmed, the letter is estimated to have such a thickness that the forward end thereof reaches a point where the light path 135 of the passage sensors 134*a*, 134*b* intersects the light path 143 of the passage sensors 142*a*, 142*b*. Subsequently, the apparatus stands by until the forward end of the letter reaches the passage sensors 144*a*, 144*b* downstream in the direction of conveyance (step 167). After the forward end of the letter reaches the passage sensors 144*a*, 144*b*, the state of the passage sensors 134*a*, 134*b* is checked (step 168). In the case where the light path 135 of the passage sensors 134*a*, 134*b* is transversed again by a letter, a letter overlap is considered, and a reject command is issued (step 180). An assumed temporal range of letter displacement is set (step 170), during which the detection operation is continued.

In the case where the forward end of a letter along the height thereof is not detected in the passage sensors 134*a*, 134*b* (step 174), an assumed temporal range of letter displacement is set by a timer (step 176), during which time the detection is continued.

In the case where letters have different thicknesses, the forward ends of letters come into contact with different points on the conveyance path surface 5*b*, so that the passage sensors, if provided only one set, are liable to produce a detection error. According to this embodiment, however, an overlapped state can be positively detected even when letters conveyed have different thicknesses.

Also, the detection means according to this embodiment can be improved in detection accuracy free of a change in the output of the sensors which otherwise might be caused by fluctuations of the light reflectivity of the letter surface, thereby making possible the detection of overlapped letters by less expensive passage sensors.

Figure 22:
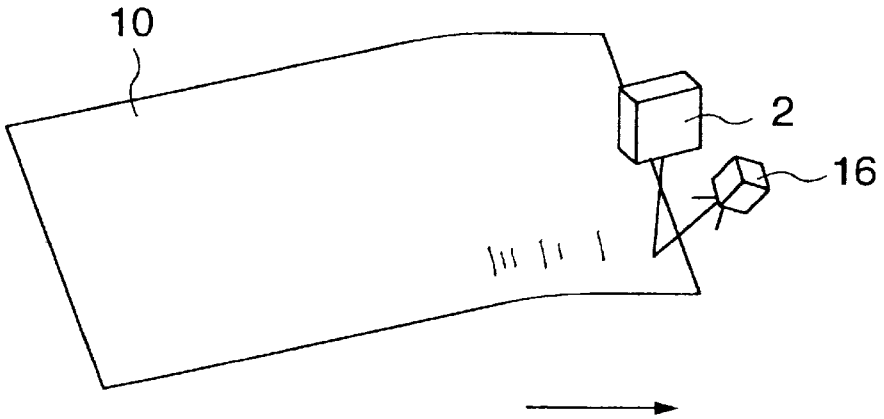
FIG. 22 shows the noise canceller of FIG. 5 according to an embodiment.

FIG. 22 is a diagram showing the noise canceller 22 of FIG. 5 according to an embodiment. A light quantity sensor 16 can measure the change in light quantity of a phototransistor and the like. The distance sensor 2 projects a laser beam on an object for measuring the distance and is arranged at a position where the quantity of the laser beam reflected on a letter can be measured.

The distance sensor, which projects a laser beam on an object and measures the distance of the object by measuring the reflected spot light by an optical position detector, develops a noise in the measurement waveform in the case where a lesser quantity of the laser beam is reflected due to the change in reflectivity, the presence or absence of characters, the change in color, etc. of the letter surface. Such a noise is sometimes difficult to distinguish from the waveform unique to an overlapped state, and is a factor contributing to an erroneous detection of a single letter as overlapped letters. This detection error can be prevented by measuring the quantity of the reflected laser beam by the light quantity sensor 16 and judging as a noise the waveform measured in the case where the light quantity is not more than a predetermined value.

It will thus be understood from the foregoing description that an overlap detection apparatus according to this invention can positively detect an overlap of any combinations of different types of objects.

What is claimed is:

1. An overlap detection apparatus comprising:

a conveyance path for conveying letters including a letter release section where said letters are not held and a bending section formed in said letter release section;

a butt into which the forward end of the letters released from said conveyance path in said bending section is brought into contact;

a detector for detecting the forward end of a letter on said butt; and overlap judging means for judging an overlap of letters based on the result of detection by said detector; and wherein said detector includes a light source for projecting light on the surface of a letter and a line sensor having a plurality of light receiving elements arranged in a line, said line sensor detecting a shadow of the forward end of the letters cast by said light source.

2. An overlap detection apparatus according to claim 1, wherein said line sensor is arranged in the neighborhood of said butt and substantially in parallel to a moving locus of the forward end of the letters on said butt.

3. An overlap detection apparatus according to claim 1, wherein said line sensor simultaneously detects a plurality of shadows of the forward end of a plurality of letters to detect an overlap of the letters.

4. An overlap detection apparatus comprising:

a conveyance path for conveying letters including a letter release section where said letters are not held and a bending section formed in said letter release section;

a butt into which the forward end of the letters released from said conveyance path in said bending section is brought into contact;

a detector for detecting the forward end of a letter on said butt; and overlap judging means for judging an overlap of letters based on the result of detection by said detector; and wherein said detector is a passage sensor having a light path which is substantially at a right angle to a conveying direction of the letters and substantially in parallel to the surface of the letters, and arranged in said conveyance path in the neighborhood of said butt.

5. An overlap detection apparatus according to claim 4, wherein said passage sensor detects the forward end of the letters a plurality of times within a predetermined period of time to detect an overlap of letters.

* * * * *